United States Patent [19]

Pfeiffer

[11] 4,272,649

[45] Jun. 9, 1981

[54] PROCESSOR CONTROLLED SOUND SYNTHESIZER

[75] Inventor: Randall R. Pfeiffer, Costa Mesa, Calif.

[73] Assignee: Williams Electronics, Inc., Chicago, Ill.

[21] Appl. No.: 28,079

[22] Filed: Apr. 9, 1979

[51] Int. Cl.[3] ..... G10L 1/00

[52] U.S. Cl. ..... 179/1 SM

[58] Field of Search ..... 179/1 SA, 1 SM, 1 SF; 84/1.01, 1.03, 1.17; 340/148, 692

[56] References Cited

U.S. PATENT DOCUMENTS

| | | | |
|---|---|---|---|
| 4,016,540 | 4/1977 | Hyatt | 179/1 SM |
| 4,117,263 | 9/1978 | Yeh | 179/1 SM |
| 4,125,898 | 11/1978 | De Hart et al. | 179/1 SM |

OTHER PUBLICATIONS

S. Smith, "Single-Chip Synthesizers", Computer Design, Nov. 1978, pp. 188, 190, 192.

Atari, Inc., "Middle Earth", Data Sheets.

V. Tandon, "Tired of Just Reading Results?", Electronic Design, Nov. 22, 1978, pp. 160-163.

Texas Instruments Inc., "SN76477, Application Notes".

D. Cannon, et al., "Designing With Microprocessors", Texas Instruments, 1975, pp. 110-113.

*Primary Examiner*—Charles E. Atkinson

*Assistant Examiner*—E. S. Kemeny

*Attorney, Agent, or Firm*—McDougall, Hersh & Scott

[57] ABSTRACT

An electronic circuit is disclosed which is capable of producing synthesized sounds under the control of a microprocessor or other type computer. A plurality of switch inputs are provided whereby the sound to be produced can be selected. The processor, under program control, then generates such sounds utilizing one or more basic waveforms stored in a memory. These basic waveforms are modified in specified ways and then outputted through an I/O device to a digital to analog converter for application to an audio system. Eight input control lines to the microprocessor also feed an 8-input NAND gate, such that a momentary change of the normally-high control inputs will cause the NAND gate to activate an interrupt request.

3 Claims, 6 Drawing Figures

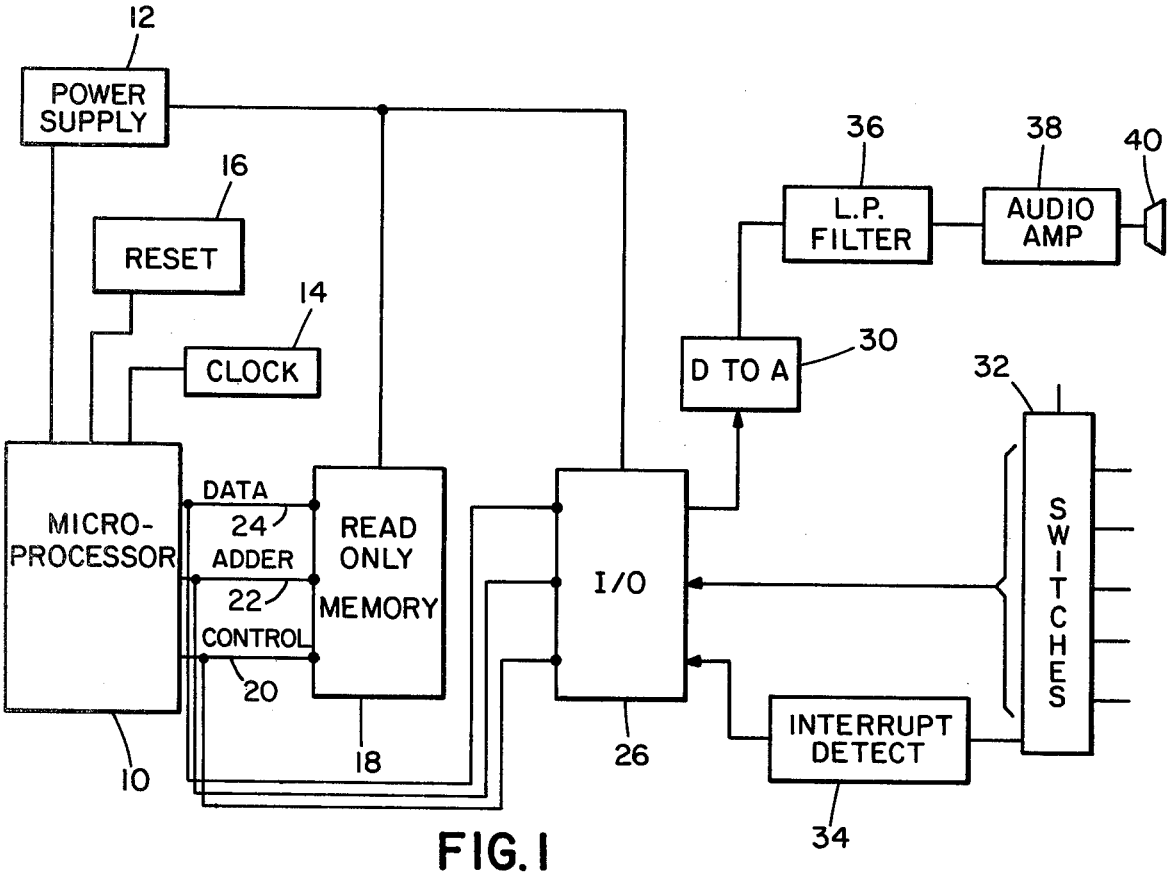
FIG. 1
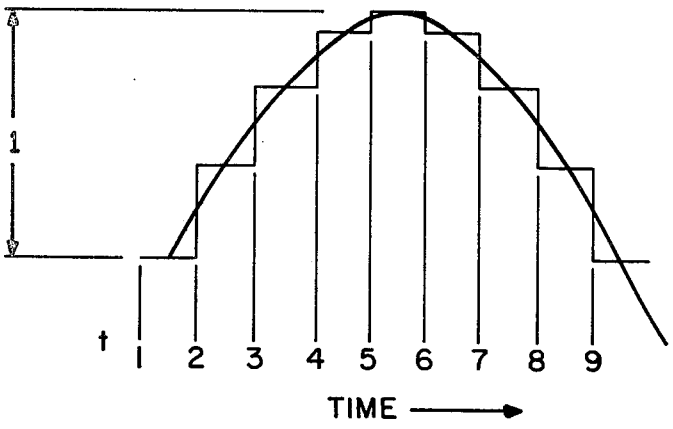
FIG. 3
| TIME | VALUE |
|---|---|
| $t_1$ | 0 |
| $t_2$ | .35 |
| $t_3$ | .66 |
| $t_4$ | .80 |
| $t_5$ | 1.0 |
| $t_6$ | .80 |
| $t_7$ | .66 |
| $t_8$ | .35 |
| $t_9$ | 0 |
FIG. 4

PROCESSOR CONTROLLED SOUND SYNTHESIZER

BACKGROUND OF THE INVENTION

This invention relates to the field of sound generating devices. More specifically, it relates to sound synthesizing circuits capable of reproducing common sound, such as, words, noise, music and the like. Such circuits find application where it is desired to permit devices to communicate or interact with human beings for various purposes. For example, it is becoming desirable to permit computers to interact with human beings by methods other than printers or CRT displays. For that purpose it would be desirable to have a synthesizing circuit which could permit a computer to "talk" to a user.

Other applications include educational uses, uses to provide alarm and warnings in the event that malfunctions are detected and finally such circuits find application when used for a wide variety of consumer products including those which may be broadly categorized as games. Such circuits find wide use in the game category in arcade games, home video games, pinball games, and the like. In these applications the sound circuit may be used to provide an incentive to play the games or as a reward for achieving certain goals set up in the game as, for example, obtaining a high score, winning a free game or activating a sequence of targets in a desired order. The addition of sound to such games enhances their attractiveness to the players and makes the experience more enjoyable.

One approach in producing synthesized sound is to store the entire waveform corresponding to the desired sound in a read only memory (ROM) in digitized form. A clock circuit in conjunction with necessary logic is then used to sequentially clock out the waveform to an audio circuit. Such an approach is limited in that number of sounds which can be produced is a function of memory space available which space is expensive.

An alternate method of generating synthesized sounds includes the use of a circuit having a plurality of oscillators and means for gating the oscillators on and off for producing various noise sounds. Again, the resulting output which can be produced by such a circuit is clearly limited.

It is accordingly an object of the present invention to provide a digital sound synthesizing circuit which is more flexible and has greater capabilities than those previously developed.

It is another object of the invention to provide a processor controlled sound synthesizing circuit which can alter one or two basic waveforms stored in a memory in myriad ways to produce different sounds, as desired, responsive to a switch input to the processor.

It is another object of the invention to provide a processor controlled sound synthesizing circuit capable of producing a large family of sounds with only a small memory associated therewith by utilizing program control to digitally alter the waveforms.

A further object of the invention is to provide a sound synthesizer for an arcade type game in which sounds are produced according to the received inputs from said game.

Other objects and advantages of the invention will be apparent from the remaining portion of the specification.

SUMMARY OF THE INVENTION

The present invention employs a microprocessor to produce synthesized sound. The microprocessor is programmed to utilize one or more basic waveforms stored in digital form in an associated ROM to produce noise, music or tones. The basic waveforms may have their amplitude, frequency and rate and change of these variables altered during the process of withdrawing the waveform from the ROM and transmitting it to the audio portion of the circuit. In addition, pseudo-random noise may be added to the waveform to produce sounds which are typical of those heard in nature as, for example, thunder, car traffic, etc. Likewise, musical passages can be produced by the synthesizer and the digital techniques disclosed herein permit the key, tempo and other variables to be altered, as desired, responsive to input switches and program control.

BRIEF DESCRIPTION OF THE DRAWINGS

FIG. 1 is a block diagram of the processor controlled synthesizer according to the invention.

FIG. 3 is a diagram useful in understanding the method by which a waveform is digitized and stored in memory.

FIG. 4 is a table for use in conjunction with an explanation of the FIG. 3 diagram.

DETAILED DESCRIPTION

Figure 2A:
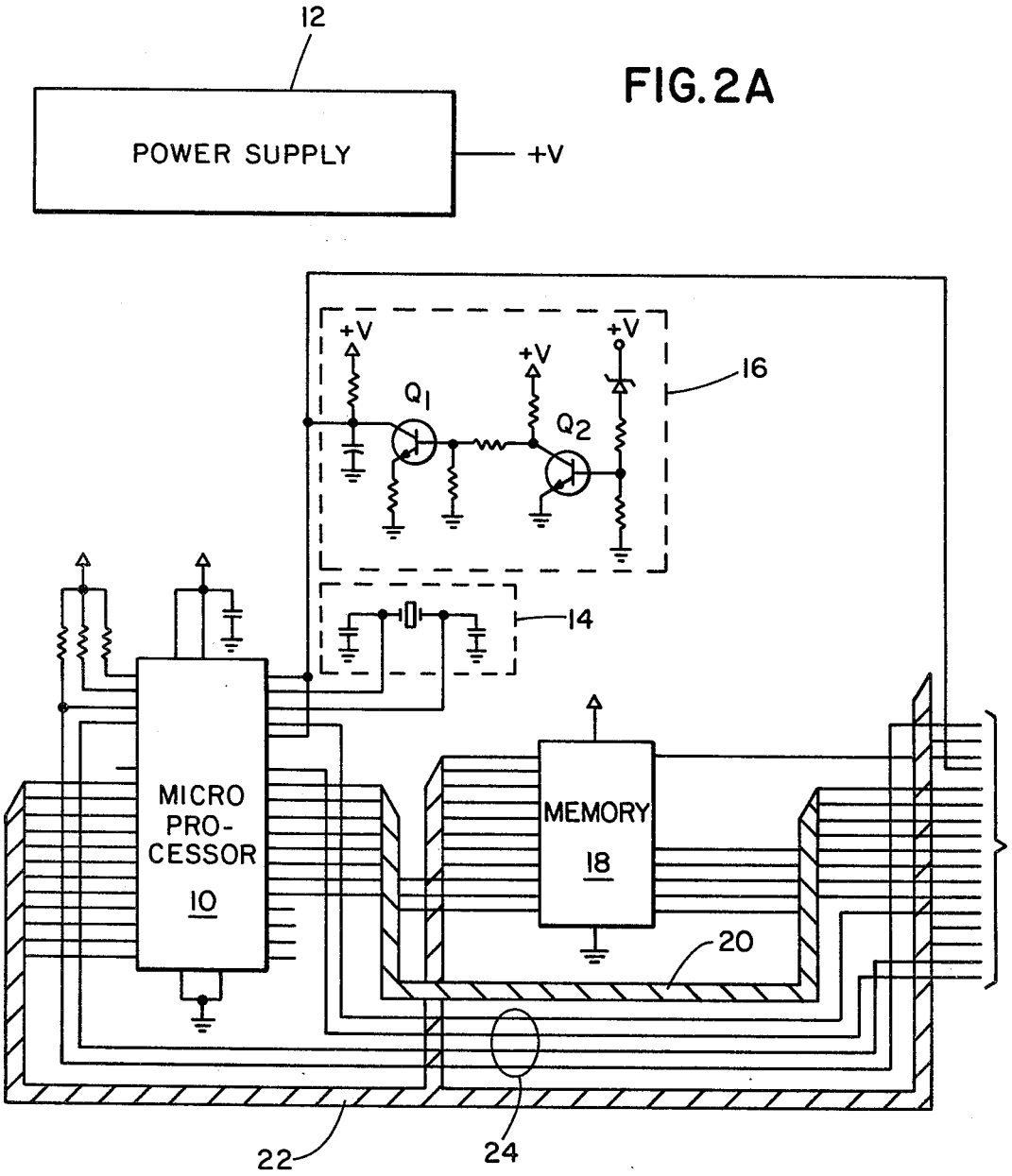
FIG. 2 (comprised of 2A and 2B) is a detailed schematic of the circuit according to the invention.

Referring to FIG. 1, a simplified block diagram of the electronic sound synthesizer according to the invention is illustrated. A computer, processor or, preferably, a microprocessor 10 is provided along with an associated power supply 12, clock 14, and power on reset circuit 16. The processor may be selected from a number of those which are commercially available as, for example, the microprocessors offered by Intel, Rockwell or Motorola Corporation. A specific example of a processor suitable for use according to the present invention is the Motorola M6802. The program for controlling the processor 10 is stored in a memory 18 which may be a read only memory (ROM) or a programmable read only memory (PROM) as desired.

In addition to the program, which is outlined in connection with the description of FIG. 5, one or more basic waveforms are stored in the memory 18 as, for example, a digitized version of a sine wave, triangular wave, square wave, musical passage or voice pattern as will be described subsequently. As is known by those skilled in the art, the necessary registers for the central processing unit (CPU) and the random access memory (RAM) is contained directly on the microprocessor chip in the case of the Motorola M6802.

The microprocessor is connected to the ROM 18 by means of a data bus 20, an address bus 22, and a control bus 24. These three buses are also connected to an input output (I/O) device 26 as, for example, a peripheral interface adapter (PIA). The PIA is a device offered commercially by Motorola Corporation and is particularly suited for use in the present invention. Reference is made to the Motorola M6800 Microprocessor Applications Manual 1975 Ed. for more information concerning the microprocessor and PIA and said Manual is hereby incorporated by reference.

The PIA 26 offers a total of sixteen lines which may be utilized as inputs to or outputs from the microprocessor. In the present invention eight lines are utilized as outputs to a digital to analog converter 30 while the remaining eight lines are utilized as input lines from a set of switches 32. In addition, the PIA 26 includes an interrupt request input which can signal the microprocessor when an interrupt is requested. Connected to the interrupt input is an interrupt detector 34 for a purpose to be described.

The output of the digital to analog converter 30 is provided to a low pass filter network 36 for smoothing out the essentially square wave-like waveforms produced by the digital techniques of the present invention. This tends to eliminate the common objection to synthesized sounds that they sound "electronic". The filtered output from the converter 30 is applied to an audio amplifier 38 and ultimately to a speaker 40 to produce the desired sounds.

Based on the foregoing block description of the invention, the system operation can be perceived. Depending on the input from switches 32, the microprocessor 10, under control of the program stored in the ROM 18, will digitally manipulate a basic waveform also stored in the ROM 18 to alter its amplitude, its period (1/freq.), its rate of change of amplitude and period, and in addition, is capable of generating and adding a noise component to the waveform when desired. After the waveform has been extracted from memory and digitally processed, it is outputted to the digital to analog converter 30 through the I/O device 26. It is then applied to the audio amplifier 38 for playing through speaker 40. Because of the manipulative ability of the processor only a few basic waveforms need be stored in the ROM 18. The processor is capable of modifying and combining these waveforms in myriad ways to produce a desired output. For example, multiple basic waveforms may be altered and summed together.

Figure 2B:
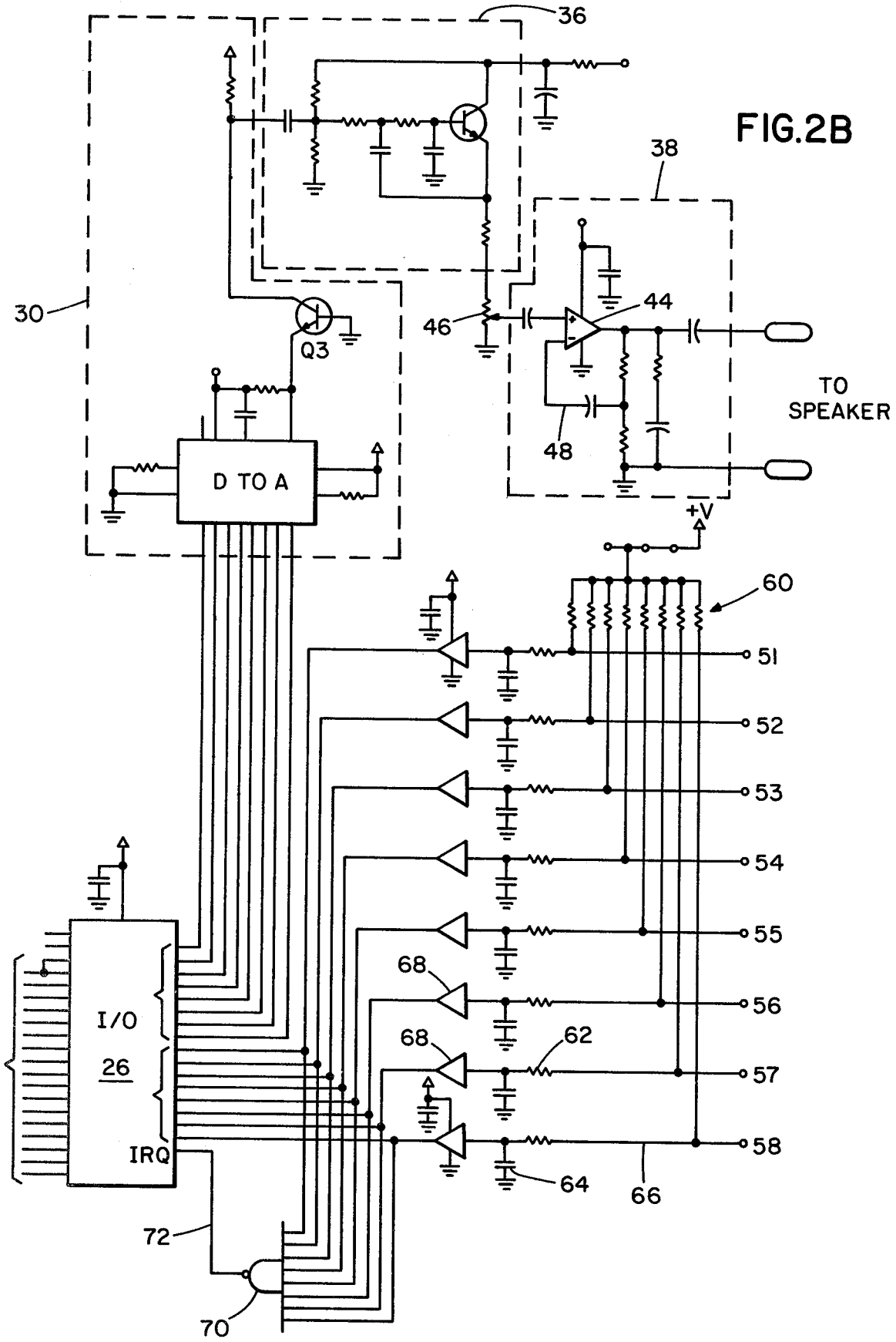

Referring to FIG. 2, a detailed schematic of the invention is illustrated. The schematic has dashed boxes corresponding to the blocks shown in FIG. 1 for ease of identification. Bux interconnection between the processor 10, the ROM or PROM 18 and the PIA 26 is shown. The clock 14 consists of a simple crystal connected to the processor and, for example, a crystal frequency of approximately 3.58 MHz. is satisfactory for the present application. Reset circuit 16 is a simple delay circuit which prevents the processor from starting operation before the voltage applied to its input reaches a minimum threshold value. When the minimum threshold is reached a transistor Q2 begins conducting which, in turn, shuts off transistor Q1 enabling the microprocessor.

The eight output lines from the I/O 26 are provided to the digital to analog converter 30 consisting of a commercially available Motorola M1408 integrated circuit 42 and a bi-polar transistor Q3 connected to the IC output. The collector of transistor Q3 is connected to filter network 36. Such a digital to analog converter is known and will be familiar to those of ordinary skill in the art. The low pass filter 36 receives the output from the digital to analog converter and, as indicated previously, smooths the output. The output of the filter is applied to an operational amplifier 44 via a volume control 46. The amplifier includes a capacitive gain feedback loop 48. The output from the amplifier 44 is then provided to a speaker for producing the sound created by the circuit.

The eight input lines to the I/O device 26 are provided from terminals 51 through 58. These terminals can be connected to any kind of a switch as, for example, a solenoid device, a relay device, an electronic switch or logic gate or otherwise. The only requirement is that the state of each terminal represent one of two binary values, zero or one, respectively, and that the voltage level of the binary values be compatible with the I/O device. The input terminals 51–58 are connected to a set of pull up resistors 60 to provide the necessary voltage level for the circuit in the usual case where the inputs are from logic gates. RC slow down networks are provided in each line as, for example, resistor 62 and capacitor 64 in line 66. The slow down networks are utilized in order to reduce the possibility of noise from other circuitry interfering with proper operation of the sound synthesizer. The RC network tends to eliminate the possibility that a switch will be misread due to the presence of high frequency noise in the system.

The inputs of terminals 51 through 58 are provided through buffering amplifiers 68 to the I/O device. These inputs to the I/O device are also connected as inputs to NAND gate 70, the output of which is connected to the interrupt request line of the I/O device 26. NAND gate 70 permits the processor to operate more efficiently. In a typical microprocessor application, a large matrix of switches or other elements will be connected to the processor via an I/O device. In order to determine the state of these devices, the processor must cyclically poll each input line to determine its state. Although capable of doing this at a high speed, the effect of this continuous polling is to reduce the amount of time for the processor to do internal computation and calculations.

According to the present invention, the microprocessor does not repetitively poll the input lines 51 through 58. The inputs are polled only when an interrupt is generated by gate 70. When any one or more switch lines 51 through 58 is activated, it produces a change in the output state of gate 70 thereby changing the level of the input to the I/O device on line 72. This signals the microprocessor to interrupt its current operating cycle and poll the switch lines 51 through 58 to determine what activity has taken place. In the absence of an interrupt request, the processor is free to do the internal computations necessary for producing synthesized sounds.

Turning now to FIG. 3, a representation of a sine wave is shown which has been approximated by a plurality of discrete values. These values may be digitized and stored in the memory 18 of the microprocessor. For purposes of explanation, only one half of the sine wave has been digitized and divided into eight discrete time intervals $t_1$ through $t_8$. Obviously, a greater or lesser number of time intervals can be used for digitizing. The greater the number of intervals employed the more accurate the digital approximation of the waveform.

Referring to FIG. 4, it will be seen that for each time interval the value which would be stored in the processor memory to correspond to the sine wave is indicated. Thus, for $t_1$ the value stored would be zero. For $t_2$ the value 0.35 would be stored for a normalized sine wave having a maximum excursion above zero of 1. The remaining values are indicated in the table. Each of these digital values in the table will be referred to in this specification as an amplitude value or simply an A value.

In order to produce a sound corresponding to a digitized waveform, such as the sine wave of FIG. 3, the circuit according to the invention periodically retrieves from the memory each succeeding A value and outputs it through the I/O device to the digital to analog converter. Thus, for the eight time periods represented in FIG. 4, the digital representation of the values zero through one will be outputted to the digital to analog converter 30. It will be readily apparent that the number of samplings can be increased or decreased, as desired, and this sampling or data transfer rate must be sufficiently high to accurately reproduce the intended sound waveform.

The time that each A value remains outputted to the digital to analog converter is a function of the frequency of the waveform to be reproduced. Period is the reciprocal of frequency and it is convenient to discuss the time each A value is maintained in terms of a waveform period.

An important characteristic of the waveform to be reproduced is the time rate of change of its amplitude and/or its period. In conventional radio engineering this is known as the waveform envelopes. Thus, for example, a waveform of constant period may have an amplitude which is a time varying function thereby producing an alternately increasing and decreasing volume. Conversely, the period may change with time while the amplitude is constant or also changes.

An important aspect of the invention is the ability to generate noise waveforms and combine them with the stored waveforms. Such waveforms may be produced by generating pseudo-random numbers with the microprocessor and using these to determine the parameters (i.e., amplitude, frequency, rate of change, etc.) of a stored waveform which can then be combined with other stored waveforms. Alternately, the pseudo-random number generated waveforms can be used exclusively to produce electronic noise or sound, where desired.

It is possible to effect at least five different types of operations upon a stored waveform by use of the microprocessor according to the invention: The amplitude of the stored waveform can be increased or decreased as desired by scaling each A value in the microprocessor arithmetic registers prior to outputting it to the I/O device. The period over which the A value is outputted can be increased or decreased in the same manner thereby changing the period of the waveform. Both the amplitude and period of the waveform may be altered. The rate of change of the amplitude and/or period of the waveform may change with time (dA/dt, dP/dt). The processor's computational capability may be utilized to generate random numbers to produce noise waveforms having pseudo-random amplitudes and periods. These noise waveforms may be imposed upon the sound waveforms or utilized by themselves.

Having outlines some of the possible ways in which a stored waveform may be manipulated by a microprocessor prior to be provided to the digital to analog converter 30, a flow chart for programming the microprocessor will now be discussed.

Figure 5:
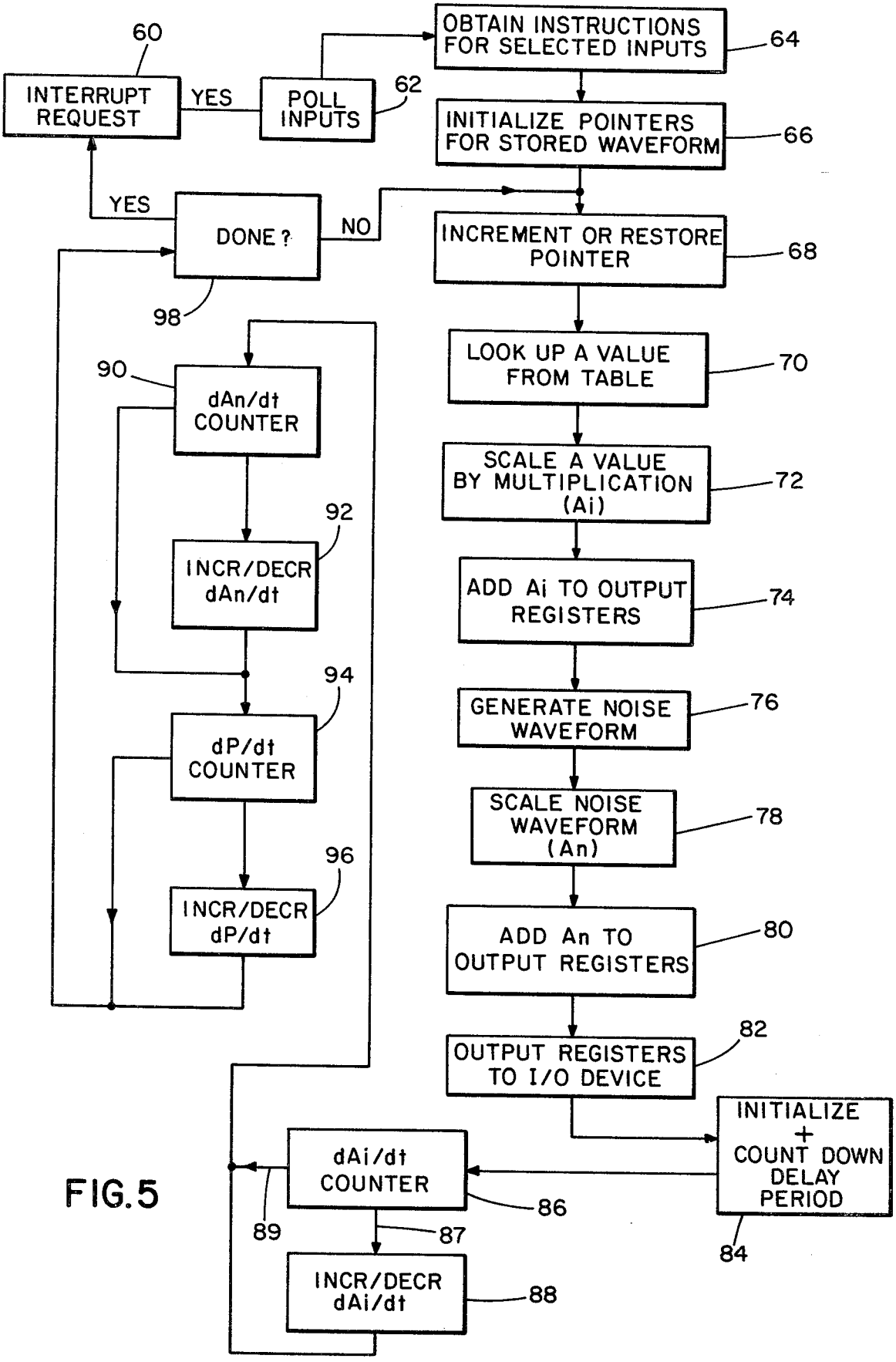
FIG. 5 is a software flow diagram which details the manner of operation of the microprocessor according to the invention.

Referring now to FIG. 5, a flow chart is illustrated. It will be apparent to those skilled in the art that this flow chart is but one of many that can be drawn to implement the functions previously described. It will also be recognized that from the FIG. 5 flow chart, program instructions can be written to accomplish the function specified in each block of the flow chart. Specific program instructions will, of course, differ from one type of processor to the next and thus specific machine language instructions provided for a given microprocessor would not be appropriate for use with a different processor.

Box 60 is the interrupt request which is triggered by an input from NAND gate 70 (FIG. 2). This subroutine detects that one of the switches 51 through 58 has been actuated and that the microprocessor should initiate a polling cycle in which each of the switches is polled to determine which have been closed. Upon receiving the interrupt request the processor initiates the polling routine at 62. Depending upon the switches actuated the processor will transfer various waveform parameters stored in the ROM to its RAM for use in the subsequent processing steps. This is indicated by box 64.

The parameters which typically are transferred include the amplitude value (the A value) of a selected waveform, the rate of change of the A value, the period of the waveform, the rate of change of the period. In addition, there will be housekeeping data such as the location of the initial starting address in memory for the look-up tables.

The software will next initialize the processor pointers for the selected waveform look-up table so that it will correctly sequence through the ROM to obtain the desired waveform. This is indicated by box 66. After completing each loop through the software program indicated, box 68 requires that the pointers be incremented or restored for another cycle through the look-up table. Box 70 indicates that the instantaneous value of the waveform $A_i$ is provided to the processor arithmetic unit. Box 72 indicates that this instantaneous value is multiplied, i.e., shifted, in the processor to scale its value as determined by the program. Thus, assuming a normalized value of one, the steps indicated in box 72 may increase the value $A_i$ by any selected power of two or likewise divide it by any power of two. The scaled value, as indicated in box 74, is then provided to the processor's output register.

Box 76 provides for the generation of a pseudo-random number if the program is to produce a noise waveform. Box 78 provides for scaling of the noise waveform A value in the same manner as box 72. The instantaneous amplitude of the noise waveform is also provided to the processor output register at box 80.

At this point the combined A value outputs are provided from the output register to the I/O device 26. This, in turn, causes them to be applied to the digital to analog converter 30 and the audio system as previously indicated.

Box 84 indicates that the microprocessor then begins a delay period wherein a counter is initialized with a selected value and down counted to zero before processing continues. The delay period provided at box 84 determines the period, P, of the waveforms being produced. Decreasing the delay decreases the period of the waveform while, of course, increasing its frequency.

Box 86 indicates a counting function required in order to produce a changing envelope for the amplitude values (dAi/dt). Two output paths are shown from box 86, the first path 87 is executed when the count indicates that it is necessary to increase or decrease the rate of change of the A value. In that case the program branches to box 88 and effects the necessary increase or decrease. If counter 86 has not reached the number of counts to which it is set for a specified waveform, the box 88 is bypassed on line 89 and the program continues at box 90.

In a similar manner boxes 90 and 92 provide a counter mechanism for determining when to increase or decrease the rate of change of the A value for the noise waveform if one is provided. Likewise, boxes 94 and 96 provide for increase or decrease in the rate of change of the period of the waveforms being produced. Upon accomplishing these tasks the program returns to box 68 where a new cycle continues unless box 98 detects that the entire waveform to be produced has been finished. If that is the case the program routine is terminated and the microprocessor reverts to an idle mode waiting for the next interrupt request as indicated at box 60.

From the foregoing description it will be apparent that the invention is an extremely versatile sound synthesizing system. All of the signal processing is accomplished digitally and, therefore, the processor can manipulate stored waveforms to produce a wide variety of sounds from only a few basic waveforms stored in the ROM. Additional waveforms can be stored as, for example, where it is desired to repetitively play a musical composition over and over. The composition can be stored directly in ROM and merely clocked out by the processor without alteration or processing by the system. The period, and hence pitch, of the composition can be determined by the processor program. However, where variety and an element of randomness are desirable the capability of the present invention permits a wide range of options by which the stored waveforms can be altered. In the case of noise, pseudo-random waveforms can be generated and played out whereby realistic results are obtained for emulating natural phenomena, such as, thunder, whistles, train noises, etc.

The circuit permits the variation of the parameters associated with a waveform including its period, amplitude and the rate of change of these values.

While we have shown and described embodiments of this invention in some detail, it will be understood that this description and illustrations are offered merely by way of example, and that the invention is to be limited in scope only by the appended claims.

I claim:

1. A method of synthesizing sound comprising the steps of:

(a) storing in a processor memory data from which the sound waveforms are to be synthesized and a program for causing said processor to produce digital representations of the sound waveforms, (b) executing selective portions of said program utilizing selected data depending upon the sound waveform desired, including the substeps of:

(i) providing data lines connected to said processor, the logic state of said lines being externally controlled to select the portions of said program executed and the data utilized, (ii) detecting a change in the logic state of said data lines, (iii) causing said processor to poll said data lines whenever a change is detected thereby to control the operation of said processor, (c) converting said digital representation to corresponding analog sound waveforms, (d) applying said analog sound waveforms to audio means to produce the desired sounds.

2. A sound synthesizing circuit comprising:

(a) a program controlled digital processor having an interrupt capability including a central processing unit, memory circuits having a program and data relating to the sounds to be produced stored therein, and an input/output (I/O) device, (b) means for selecting the data utilized and the portions of the program in memory to be executed by said processor, said program causing said processor to produce a digital representation of a desired sound waveform, said selecting means including a plurality of externally controlled data lines connected to said I/O device, the logic state on each of said lines determining the data utilized and the portion of the program to be executed, (c) interrupt signalling means connected to said data lines for detecting a change in the logic state of any one or more of said lines and providing an interrupt signal to said processor whereby said processor is caused to scan said lines to determine their logic states, (d) a digital to analog (D/A) converter connected to said processor via said I/O device for converting said digital representation of a sound waveform to a corresponding analog waveform, (e) audio means for receiving said analog waveform and producing sounds corresponding thereto.

3. The circuit according to claim 2 wherein said I/O device is a peripheral interface adapter having a plurality of I/O lines for communicating with said processor, a first set of said I/O lines being connected to said data lines to communicate the logic state of said data lines to said processor, a second set of said I/O lines being connected to said D/A converter to communicate the digital representation of the sound waveform to said converter.

* * * * *